US012635754B2

(12) United States Patent
Adams et al.

(10) Patent No.: US 12,635,754 B2
(45) Date of Patent: May 26, 2026

(54) SAFETY HEADWEAR SYSTEMS AND COUPLING MECHANISMS THEREFOR

(71) Applicant: Milwaukee Electric Tool Corporation, Brookfield, WI (US)

(72) Inventors: Caleb C. Adams, Milwaukee, WI (US); Patrick W. McCarthy, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 175 days.

(21) Appl. No.: 17/708,543

(22) Filed: Mar. 30, 2022

(65) Prior Publication Data

US 2022/0295934 A1 Sep. 22, 2022

Related U.S. Application Data

(63) Continuation of application No. PCT/US2022/020526, filed on Mar. 16, 2022.

(60) Provisional application No. 63/162,728, filed on Mar. 18, 2021.

(51) Int. Cl.
*A42B 3/04* (2006.01)
*A42B 3/16* (2006.01)

(52) U.S. Cl.
CPC ..... *A42B 3/166* (2013.01); *A42B 3/0406* (2013.01)

(58) Field of Classification Search
CPC .. A42B 3/166; A42B 3/16; A42B 3/30; A42B 3/0406; A42B 3/22; A42B 3/221; A42B 3/28; A42B 3/185; A42B 3/147; A42B 1/242; A42B 1/245
See application file for complete search history.

(56) References Cited

U.S. PATENT DOCUMENTS

| | | | | |
|---|---|---|---|---|
| 2,420,245 | A | 5/1947 | Hurst | |
| 2,754,519 | A | 7/1956 | Kindel | |
| 3,016,054 | A | 1/1962 | Rosenblatt | |
| 3,273,163 | A * | 9/1966 | Andrews, III ..... | A42B 3/04 2/422 |

(Continued)

FOREIGN PATENT DOCUMENTS

| | | |
|---|---|---|
| CN | 2066731 | 12/1990 |
| CN | 1052786 | 7/1991 |

(Continued)

OTHER PUBLICATIONS

VCG Construction, "Milwaukee Tools New Safety Equipment Can Save Your A****", video published on YouTube on Jan. 13, 2020, Accessed from https://www.youtube.com/watch?v=HqmGM4MYCQQ (Year: 2020).*

(Continued)

*Primary Examiner* — Patrick J. Lynch
*Assistant Examiner* — Brianna T. Duckworth
(74) *Attorney, Agent, or Firm* — Reinhart Boerner Van Deuren s.c.

(57) ABSTRACT

A coupling assembly for safety headwear is provided. The coupling assembly includes one or more apertures within safety headwear, such as a hard hat, and a coupling structure that couples to the one or more apertures. The coupling structure includes one or more surfaces that interface with the safety headwear. The coupling structure includes a protrusion that defines one or more widths, and the protrusion extends through the one or more apertures.

20 Claims, 11 Drawing Sheets

(56) References Cited

U.S. PATENT DOCUMENTS 3,306,991 A 2/1967 Wood
3,457,565 A 7/1969 Boyer et al.
3,719,954 A 3/1973 Beguin
3,862,451 A 1/1975 Miller et al.
3,944,018 A 3/1976 Satory
4,027,341 A 6/1977 Patteri
4,186,447 A 2/1980 Palmaer
4,316,290 A 2/1982 Montesi
4,347,631 A 9/1982 Newcomb
4,375,702 A 3/1983 Lundin
4,391,000 A * 7/1983 Lonnstedt ..... A42B 3/166 2/209
4,471,496 A 9/1984 Gardner, Jr. et al.
4,479,738 A * 10/1984 Kubnick ..... A61F 9/06 2/10
4,574,912 A 3/1986 Fuss et al.
4,771,859 A 9/1988 Breland
4,856,118 A 8/1989 Sapiejewski
5,012,528 A * 5/1991 Pernicka ..... A42B 3/225 2/10
5,066,154 A 11/1991 Renaud
5,384,857 A 1/1995 Nordin et al.
5,420,381 A 5/1995 Gardner, Jr. et al.
5,509,146 A 4/1996 Bryerton, Sr.
5,546,610 A 8/1996 Herzig et al.
5,551,089 A 9/1996 Whidden
5,604,813 A 2/1997 Evans et al.
5,792,998 A 8/1998 Gardner, Jr. et al.
5,809,573 A 9/1998 Bary
5,815,582 A 9/1998 Claybaugh et al.
5,920,911 A 7/1999 Cushman
5,924,138 A 7/1999 Baisden
5,996,123 A 12/1999 Leight et al.
6,456,199 B1 9/2002 Michael
6,481,846 B1 11/2002 Mikysa
6,567,525 B1 5/2003 Sapiejewski
6,611,963 B2 9/2003 Woo et al.
6,683,965 B1 1/2004 Sapiejewski
6,698,028 B2 3/2004 Daw
6,826,287 B2 11/2004 Myers
6,831,984 B2 12/2004 Sapiejewski
7,024,013 B1 4/2006 Van Dam et al.
7,171,698 B2 2/2007 Saffran
7,268,669 B2 9/2007 McEvoy
7,335,222 B1 2/2008 Tyler
7,412,070 B2 8/2008 Kleinschmidt et al.
7,444,687 B2 11/2008 Sato et al.
7,766,120 B2 8/2010 Hansson et al.
7,970,159 B2 6/2011 Kleinschmidt et al.
D663,900 S 7/2012 Karlsson et al.
D663,902 S 7/2012 Karlsson et al.
8,214,920 B1 * 7/2012 Edgar ..... A42B 3/04 2/8.2
8,223,984 B2 7/2012 Roos et al.
8,229,740 B2 7/2012 Flynn et al.
8,243,943 B2 8/2012 Nordin et al.
8,360,068 B2 1/2013 Birgersson et al.
8,374,373 B2 2/2013 Sapiejewski et al.
8,467,539 B2 6/2013 Sapiejewski et al.
8,472,636 B2 6/2013 Sibbald
8,651,229 B2 2/2014 Franzen
8,675,885 B2 3/2014 Sapiejewski
8,688,036 B2 4/2014 Parkins et al.
8,693,720 B2 4/2014 Parkins
8,934,638 B2 1/2015 Kimura
9,049,512 B1 6/2015 Kulavik et al.
9,179,728 B2 11/2015 Pfanner et al.
9,351,064 B2 5/2016 Parkins
9,414,965 B2 8/2016 Roos et al.
9,516,404 B2 12/2016 Parkins
9,522,086 B2 12/2016 Parkins et al.
9,525,930 B2 12/2016 Parkins
9,602,905 B2 3/2017 Kulavik et al.
9,628,897 B2 4/2017 Fletcher et al.
9,636,260 B2 5/2017 Jenkins
9,668,921 B2 6/2017 Vollet
9,716,938 B1 7/2017 Hoernschemeyer
9,774,946 B2 9/2017 Parkins
9,786,264 B2 10/2017 Sibbald
9,813,798 B2 11/2017 Kulavik et al.
9,827,145 B2 11/2017 Haukap
10,080,077 B2 9/2018 Silvestri
10,136,211 B2 11/2018 Jenkins
10,165,348 B2 12/2018 Kirsch
10,172,742 B2 1/2019 Fletcher et al.
10,299,024 B2 5/2019 Kulavik et al.
10,327,056 B2 6/2019 Kulavik et al.
10,349,162 B2 7/2019 Ohlander et al.
10,350,113 B2 7/2019 Le et al.
10,371,487 B2 8/2019 Hall et al.
10,440,463 B2 10/2019 Jenkins et al.
10,455,318 B2 10/2019 Jenkins et al.
10,460,718 B2 10/2019 Jenkins et al.
D868,025 S 11/2019 Brace
10,469,930 B2 11/2019 Kulavik et al.
10,499,137 B2 12/2019 Kulavik et al.
10,555,065 B2 2/2020 Kulavik et al.
10,561,532 B2 2/2020 Bui et al.
10,617,168 B2 4/2020 Winters et al.
10,617,333 B2 4/2020 Brown et al.
10,663,759 B2 5/2020 Vollet
10,735,843 B2 8/2020 Kulavik et al.
10,841,686 B2 11/2020 Brace
10,869,117 B2 12/2020 Prohaszka
10,959,477 B2 3/2021 Nordin et al.
2002/0131616 A1 9/2002 Bronnikov et al.
2004/0154082 A1 8/2004 Saffran
2004/0199982 A1 * 10/2004 Wang-Lee ..... A42B 3/225 2/10
2005/0238181 A1 10/2005 Nilsson et al.
2005/0283882 A1 12/2005 Berger et al.
2006/0067538 A1 3/2006 Huang
2007/0113320 A1 5/2007 Saffran
2007/0226865 A1 10/2007 Lindgren
2008/0235853 A1 10/2008 Sousa
2010/0012692 A1 1/2010 Harris et al.
2010/0054491 A1 3/2010 Griffin
2010/0119076 A1 5/2010 Monk et al.
2010/0284558 A1 11/2010 Kimura et al.
2010/0296682 A1 11/2010 Palmer
2010/0325784 A1 12/2010 Abbott et al.
2011/0068918 A1 3/2011 Cummings et al.
2011/0126846 A1 6/2011 Hill
2011/0225705 A1 9/2011 Fernandes et al.
2011/0314594 A1 12/2011 Rogers et al.
2012/0051576 A1 3/2012 Shiomi et al.
2012/0145694 A1 6/2012 Sousa
2013/0094658 A1 4/2013 Holter
2013/0168376 A1 7/2013 Sousa
2013/0219598 A1 8/2013 Pfanner et al.
2014/0311499 A1 10/2014 Lee et al.
2015/0167725 A1 * 6/2015 Lee ..... A42B 3/221 24/595.1
2015/0365760 A1 12/2015 Jiang
2016/0241959 A1 8/2016 Parkins
2017/0303030 A1 10/2017 Parkins
2018/0014973 A1 1/2018 Echeverri et al.
2018/0078420 A1 3/2018 Gustafsson et al.
2018/0153743 A1 6/2018 Parkins
2018/0168270 A1 6/2018 Vaccaro
2018/0193199 A1 7/2018 Back et al.
2018/0344530 A1 12/2018 Shammoh
2019/0053950 A1 2/2019 Muggleton
2019/0057681 A1 2/2019 Rachakonda et al.
2019/0075879 A1 3/2019 Persson et al.
2019/0110929 A1 4/2019 Persson et al.
2019/0320753 A1 10/2019 Le et al.
2019/0350291 A1 11/2019 Maldonado et al.
2020/0000639 A1 1/2020 Almeflo
2020/0037060 A1 1/2020 Jenkins et al.
2020/0045401 A1 2/2020 Kulavik et al.
2020/0100016 A1 3/2020 Raft
2020/0145744 A1 5/2020 Kulavik et al.

(56) References Cited

U.S. PATENT DOCUMENTS

| | | | | |
|---|---|---|---|---|
| 2020/0196698 | A1 | 6/2020 | Winters et al. | |
| 2020/0329294 | A1 | 10/2020 | Kulavik et al. | |
| 2022/0039501 | A1* | 2/2022 | Maltz | A42B 3/04 |

FOREIGN PATENT DOCUMENTS

| | | |
|---|---|---|
| CN | 103458839 | 4/2015 |
| CN | 104586574 | 5/2015 |
| CN | 204542565 | 8/2015 |
| CN | 103037725 | 11/2015 |
| CN | 205391247 | 7/2016 |
| CN | 206761828 | 12/2017 |
| CN | 207969731 | 10/2018 |
| CN | 208319408 | 1/2019 |
| CN | 106231940 | 11/2019 |
| CN | 209951558 | 1/2020 |
| CN | 110801073 | 2/2020 |
| CN | 210382800 | 4/2020 |
| CN | 210573053 | 5/2020 |
| CN | 211797222 | 10/2020 |
| CN | 112292050 | 1/2021 |
| DE | 1912241 | 3/1965 |
| DE | 2260311 | 6/1973 |
| DE | 7415619 | 8/1974 |
| DE | 2521033 | 11/1976 |
| DE | 2706382 | 8/1977 |
| DE | 2708063 | 8/1977 |
| DE | 2719503 | 11/1978 |
| EP | 2506731 | 12/2013 |
| WO | WO9325167 | 12/1993 |
| WO | WO9326083 | 12/1993 |
| WO | WO9326084 | 12/1993 |
| WO | WO9326085 | 12/1993 |
| WO | WO9748296 | 12/1997 |
| WO | WO03098966 | 11/2003 |
| WO | WO08122081 | 10/2008 |
| WO | WO17136386 | 8/2017 |
| WO | WO19104172 | 5/2019 |
| WO | WO19111214 | 6/2019 |
| WO | WO19179941 | 9/2019 |
| WO | WO20007606 | 1/2020 |
| WO | WO20019037 | 1/2020 |

OTHER PUBLICATIONS

Definition of "contiguous" from Dictionary.com. Accessed from https://www.dictionary.com/browse/contiguous on Aug. 27, 2025. (Year: 2025).*

International Search Report and Written Opinion for International Application No. PCT/US2022/020526, dated Jun. 30, 2022, 9 pages.

Howard Leight by Honeywell Leightning LOF Folding Safety Earmuff (1013461), Black, [online] retrieved Mar. 30, 2022, available from https://www.amazon.com/Howard-Leight-Honeywell-Leightning-1013461/dp/B004H38ROW/ref=sr_1_15?dchild=1&keywords=Howard%2BLeight%2Bby%2BHoneywell&qid=1588723262&sr=8-15&th=1, available at least as early as Mar. 20, 2010 per Amazon.

Prohear 016 Ear Protection Safety Earmuffs for Shooting, NRR 26dB Noise Reduction Slim Passive Hearing Protector with Low-Profile Earcups, Compact Foldable Ear Defenders for Gun Range, Hunting (Black), [online] retrieved Mar. 30, 2022, available from https://www.amazon.com/gp/product/B07YSJ4JV4/ref=ppx_yo_dt_b_asin_title_o00_s00?ie=UTF8&psc=1, available at least as early as Oct. 7, 2019 per Amazon.

* cited by examiner

SAFETY HEADWEAR SYSTEMS AND COUPLING MECHANISMS THEREFOR

CROSS-REFERENCE TO RELATED PATENT APPLICATIONS

The present application is a continuation of International Application No. PCT/US2022/020526, filed Mar. 16, 2022, which claims the benefit of and priority to U.S. Provisional Application No. 63/162,728, filed on Mar. 18, 2021, each of which is incorporated herein by reference in its entirety.

BACKGROUND OF THE INVENTION

The present disclosure is directed generally to the field of safety headwear. The present disclosure relates specifically to a coupling mechanism for safety headwear. Use of safety headwear, such as hard hats, in high-risk environments may provide added protection for head injury. Coupling various accessories to the hard hat, such as ear muffs, helps secure the accessory to the head of the user.

SUMMARY OF THE INVENTION

One embodiment of the invention relates to a safety headwear system including a safety headwear, an accessory coupled to and configured to be used contemporaneously with the safety headwear, and a coupling structure. The safety headwear includes a shell, a first aperture and a second aperture. The shell is formed from a rigid material and defines an external surface and an opposing internal surface that defines a cavity sized to receive the head of a wearer. The shell is centered on a vertical axis. The first aperture extends circumferentially around the vertical axis, and the second aperture extends circumferentially around the vertical axis. The coupling structure includes a body coupled to the accessory, an arm extending downward from the body to an end of the arm, a first support surface facing downward, and a second support surface facing downward. The first support surface includes two coplanar portions extending away from opposing sides of the arm. The two portions of the first support surface define a first distance apart from each other. The second support surface includes two coplanar portions extending away from opposing sides of the arm. The two portions of the second support surface define a second distance apart from each other that is less than the first distance.

Another embodiment of the invention relates to a safety headwear system including a safety headwear, an accessory coupled to and configured to be used contemporaneously with the safety headwear, and a coupling structure. The safety headwear includes a shell formed from a rigid material, a first aperture extending circumferentially around the vertical axis, and a second aperture extending circumferentially around the vertical axis. The shell defines an external surface and an opposing internal surface that defines a cavity sized to receive the head of a wearer, and the shell centered on a vertical axis. The coupling structure includes a body coupled to the accessory, an arm extending downward from the body to an end of the arm, a first step surface facing upward away from the end, and a second step surface facing upward away from the end. The first step surface extends radially inwardly from the arm towards the vertical axis when the coupling structure is coupled to the safety headwear. The second step surface is between the first step surface and the end of the arm, and the second step surface extends radially inwardly from the arm towards the vertical axis when the coupling structure is coupled to the safety headwear.

Another embodiment of the invention relates to a coupling structure including a body configured to couple an accessory to a safety headwear, an arm extending downward from the body to an end of the arm, a first step surface facing upward away from the end, a second step surface facing upward away from the end, a first support surface facing downward, and a second support surface facing downward. The second step surface is between the first step surface and the end of the arm. The first support surface includes two coplanar portions extending away from opposing sides of the arm. The two portions of the first support surface are a first distance apart from each other. The second support surface includes two coplanar portions extending away from opposing sides of the arm. The two portions of the second support surface are a second distance apart from each other that is less than the first distance.

One embodiment of the invention relates to a coupling assembly for safety headwear including safety headwear and a coupling structure. The safety headwear, such as a hard hat, includes a body centered on a vertical axis, a first aperture extending through the body, and a second aperture extending through the body. The first aperture circumferentially extends a first length around the body, and the second aperture circumferentially extends a second length around the body that is less than the first length. The coupling structure includes a protrusion. The protrusion includes an upper portion and an end opposite the upper portion. The protrusion includes a surface, such as an upper step surface, facing away from the end. The upper step surface extends radially inwardly with respect to the vertical axis when the coupling structure is coupled to the safety headwear. The upper step surface interfaces with the safety headwear when the coupling component is coupled to the safety headwear via the protrusion extending through the first aperture. The protrusion also includes a lower step surface facing away from the end. The lower step surface is between the upper step surface and the end of the protrusion. The lower step surface interfaces with the safety headwear when the coupling component is coupled to the safety headwear via the protrusion extending through the second aperture.

Another embodiment of the invention relates to a coupling assembly for safety headwear including safety headwear and a coupling structure. The safety headwear includes a body centered on a vertical axis, a first aperture circumferentially extending a first length around body, and a second aperture circumferentially extending a second length around the body less than the first length. The coupling structure includes a protrusion that includes an upper portion, an end opposite the upper portion, and a middle portion between the upper portion and the end. The upper portion extends a first width that is approximately equal to the first length of the first aperture. The upper portion is configured to slideably engage with the first aperture of the safety headwear. The middle portion extends a second width that is approximately equal to the second length of the second aperture. The middle portion is configured to slideably engage with the second aperture of the safety headwear.

Another embodiment of the invention relates to a coupling structure for safety headwear that includes an upper portion, an end opposite the upper portion, and a middle portion between the upper portion and the end. The upper portion extends a first width and the middle portion extends a second width that is less than the first width. The protrusion includes a first surface, such as an upper step surface, facing away from the end. The protrusion also includes a second surface, such as a lower step surface, facing away from the end. The lower step surface is between the upper step surface and the end of the protrusion.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
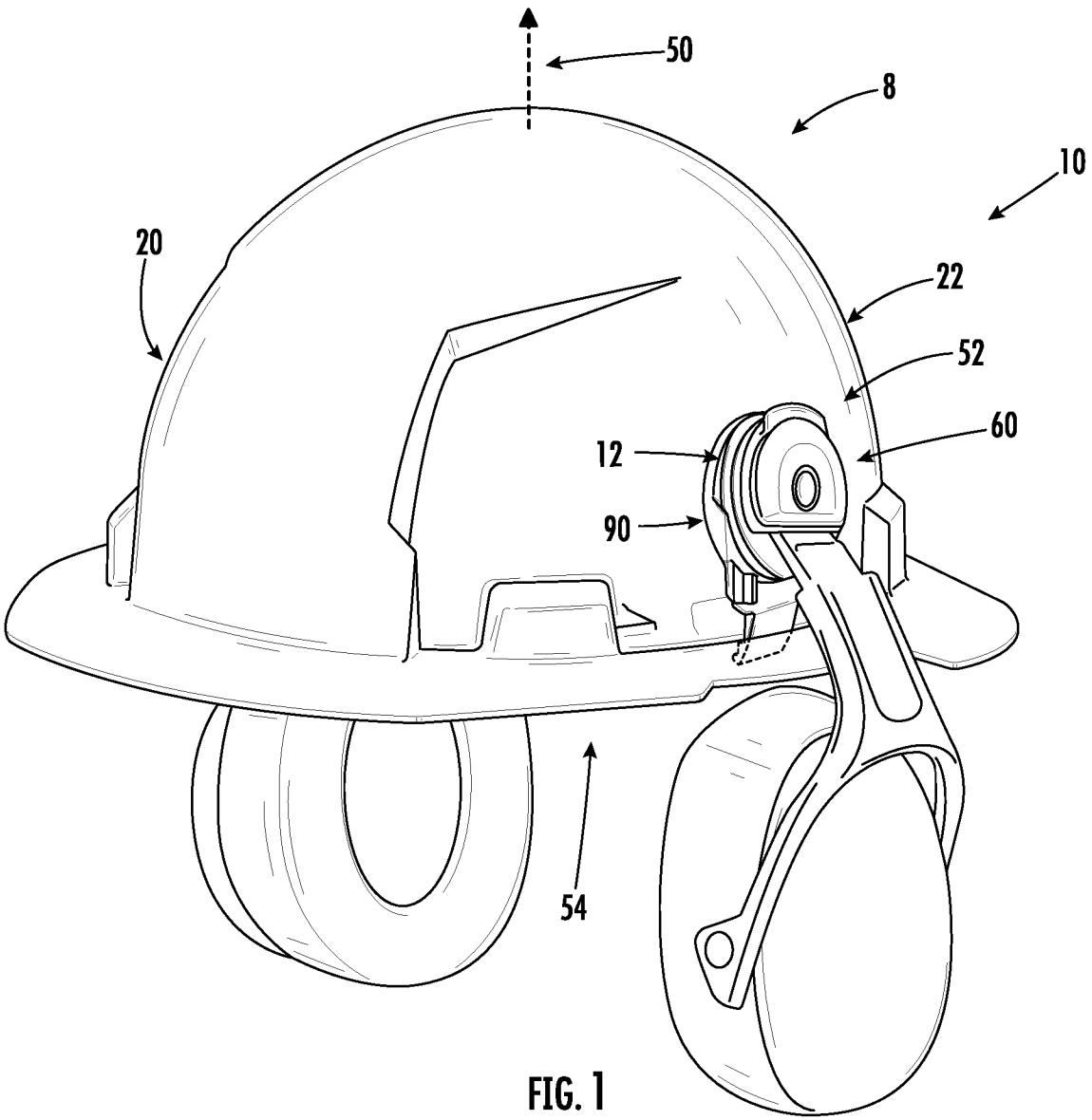
FIG. 1 is a perspective view of a safety headwear system, according to an exemplary embodiment.
Figure 2:
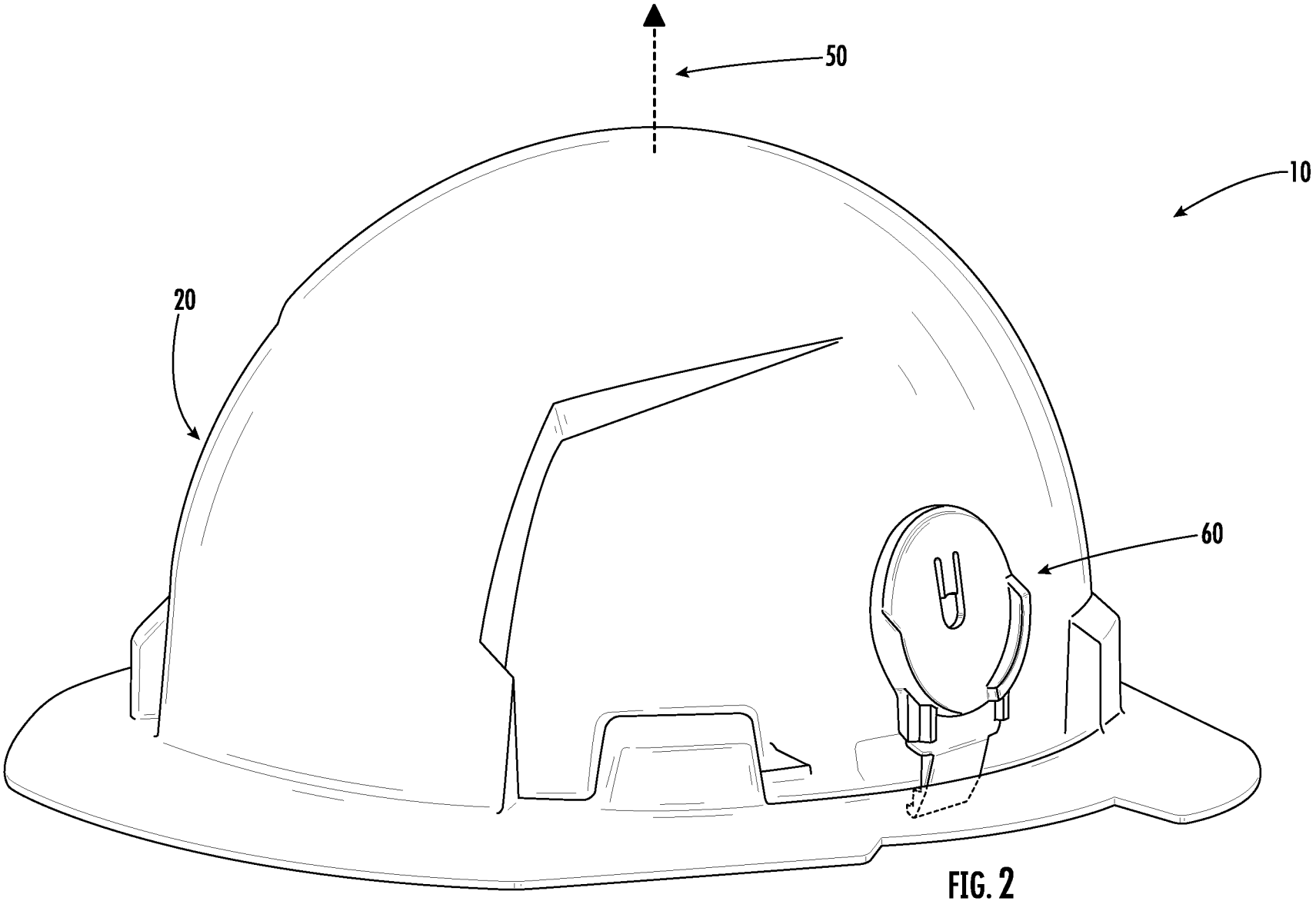
FIG. 2 is a perspective view of the safety headwear system of FIG. 1, according to an exemplary embodiment.
Figure 3:
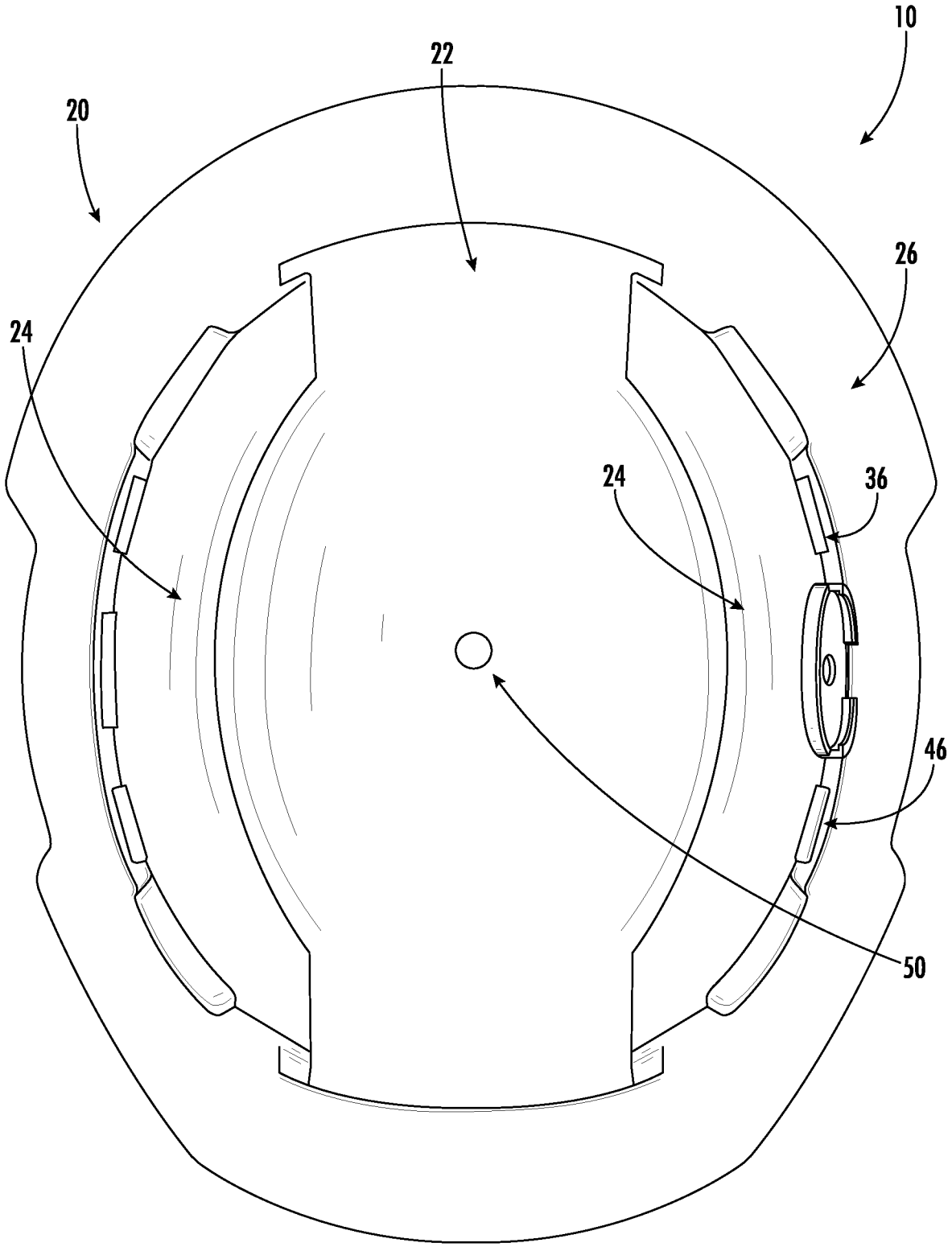
FIG. 3 is a top view of the coupling assembly of FIG. 1, according to an exemplary embodiment.
Figure 4:
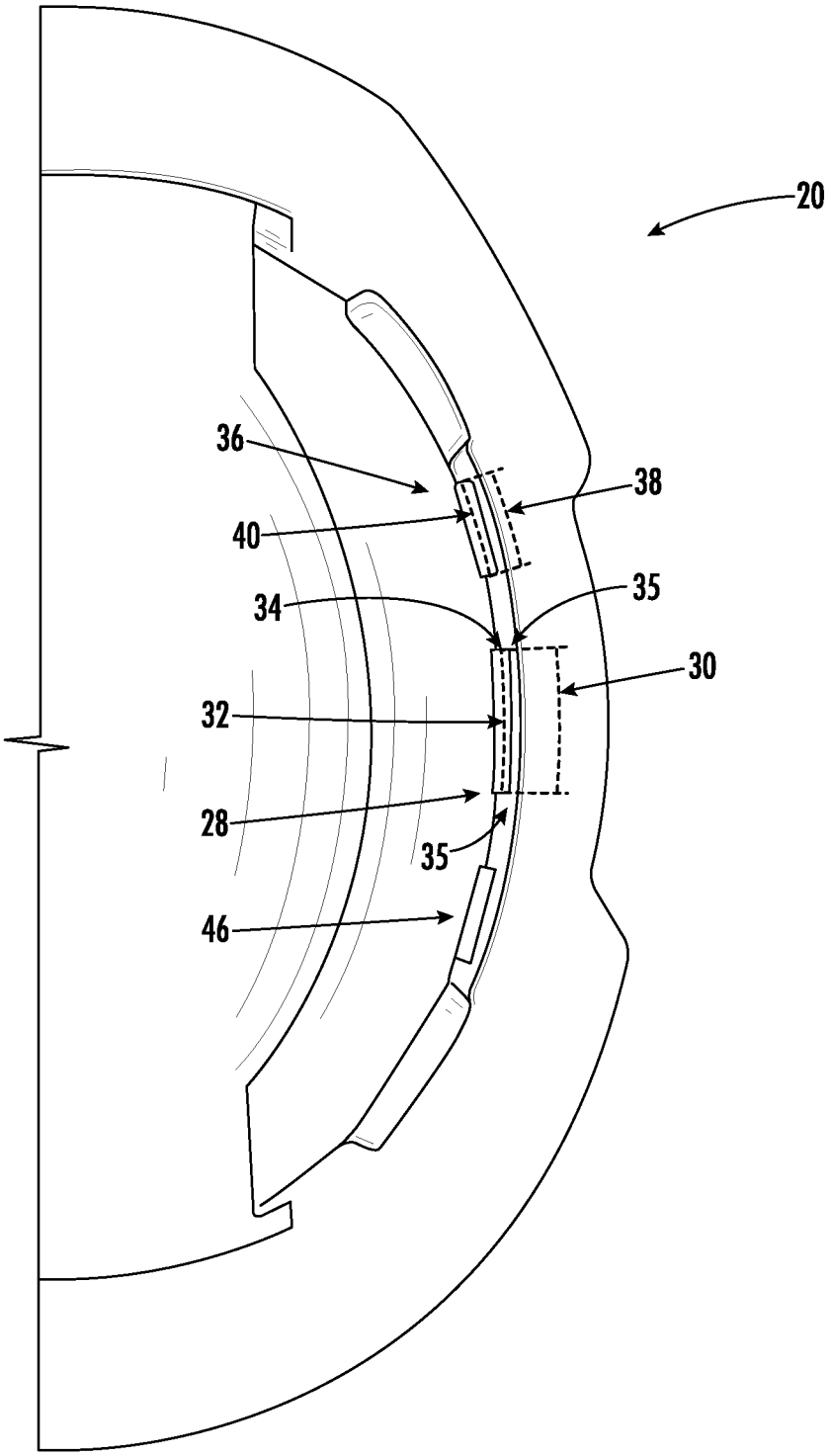
FIG. 4 is a top view of the safety headwear of FIG. 1, according to an exemplary embodiment.

Referring generally to the figures, various embodiments of a safety headwear coupling system are shown. Hard hats are used in a variety of construction jobs or other construction, residential, or commercial situations. Users of hard hats often couple various accessories to the hard hat, such as ear muffs and/or headlamps. In some attachment systems, an operator couples an accessory to the head of the operator via one or more biasing elements, such as the arms of earmuffs. However, the accessory often experiences jarring, which may cause the accessory to become unsecured and/or fall off.

In contrast, the coupling system for safety headwear discussed herein utilizes one or more coupling interfaces to couple the safety headwear and the coupling structure. The coupling structure includes one or more surfaces, such as step surfaces facing upward, that are vertically arranged along an interior of the coupling structure. The coupling structure also includes a protrusion having a width that varies along a length of a protrusion. The one or more width(s) and the one or more step surfaces provide the ability for a user to couple the coupling structure at a variety of heights relative to the safety headwear and in a variety of positions.

Referring to FIGS. 1-4, an assembly for coupling objects and headwear, shown as coupling assembly 10, is shown according to an exemplary embodiment. Safety headwear system 8 includes hard hat 20, an accessory for hard hat 20, shown as ear muff 12, and coupling structure 60 that couples ear muff 12 to hard hat 20. Ear muff 12 is configured to be coupled to and used contemporaneously with the hard hat 20. Ear muff 12 is coupled to body 90 of coupling structure 60. Body 90 is configured to couple an accessory (e.g., ear muff 12) to hard hat 20. Safety headwear, shown as hard hat 20, includes a shell 22 centered on vertical axis 50. In various embodiments, shell 22 is formed from a rigid material and includes an external surface 54 and an opposing internal surface 52 that defines a cavity sized to receive the head of a wearer. One or more openings or recesses, shown as first aperture 28, second aperture 36, and third aperture 46, are arranged at a side 24 of hard hat 20. In a specific embodiment, first aperture 28, second aperture 36, and third aperture 46 extend through hard hat 20 between shell 22 and brim 26.

First aperture 28 circumferentially extends length 30 along primary axis 32 of first aperture 28 around shell 22 and/or axis 50. Channel 34 extends from first aperture 28 through hard hat 20. Second aperture 36 circumferentially extends length 38 along primary axis 40 of second aperture 36 around shell 22 and/or axis 50. Channel 42 extends from second aperture 36 through hard hat 20. In a specific embodiment, length 30 is longer than length 38.

Third aperture 46 is functionally similar to second aperture 36, except as otherwise described. In particular, third aperture 46 is positioned in front of first aperture 28 while second aperture 36 is positioned behind first aperture 28. In various embodiments, third aperture 46 extends the same length 38 as second aperture 36. In various embodiments, the second aperture 36 and third aperture 46 are positioned on opposing ends 35 of the first aperture 28.

Figure 5:
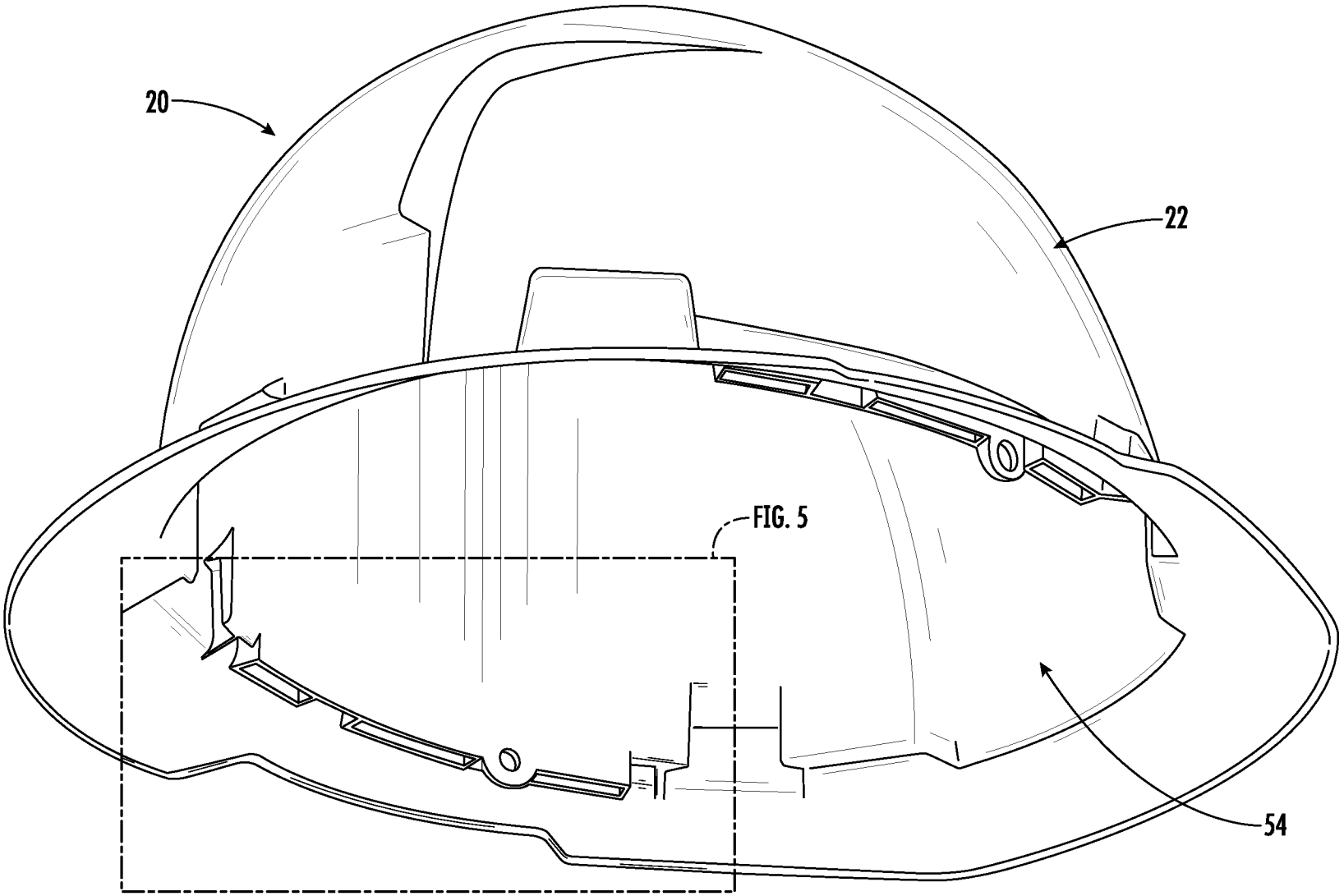
FIG. 5 is a perspective view from below of the safety headwear of FIG. 1, according to an exemplary embodiment.
Figure 6:
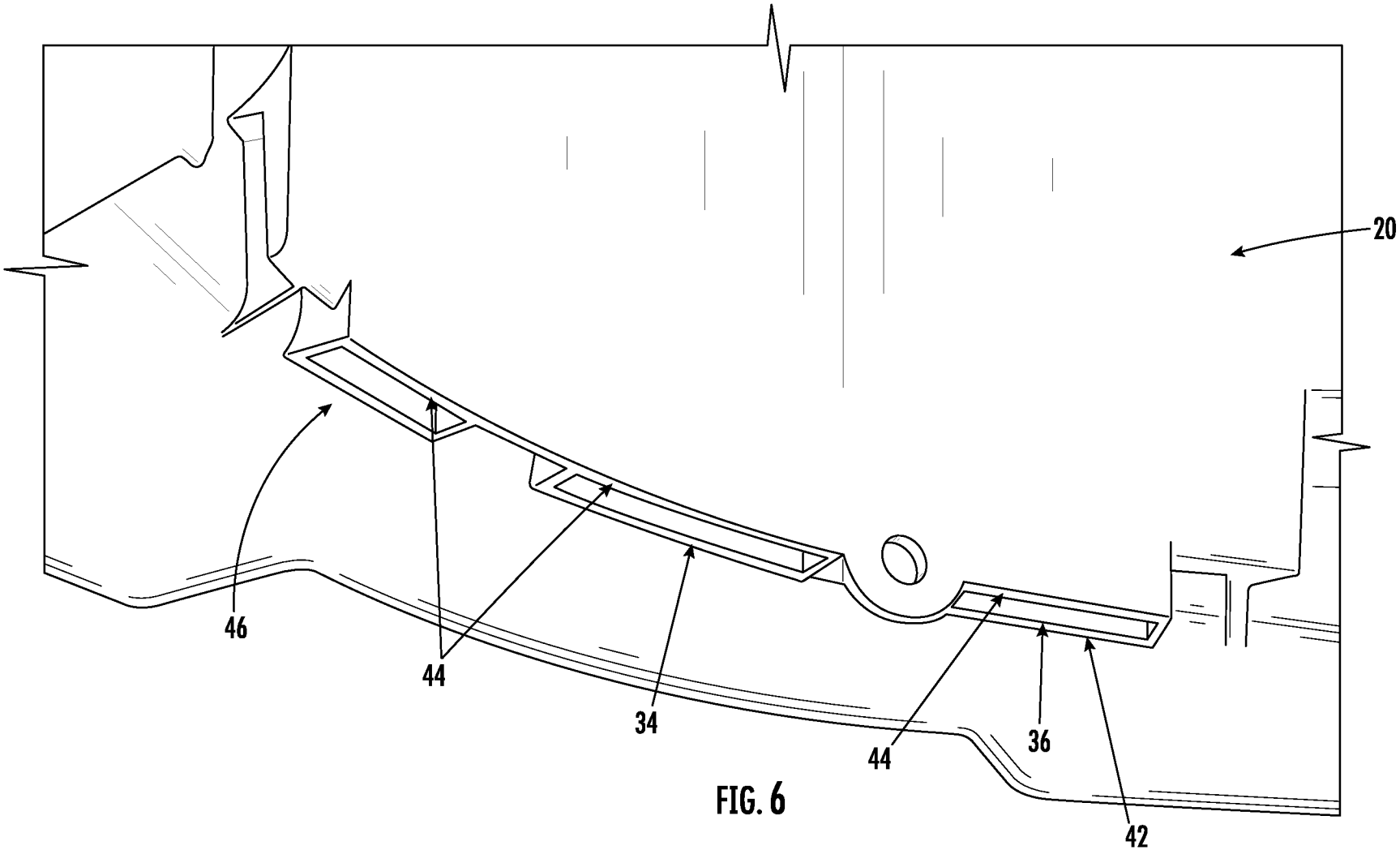
FIG. 6 is a detailed perspective view of the safety headwear of FIG. 1, according to an exemplary embodiment.

Referring to FIGS. 5-6, various aspects of hard hat 20 are shown. Hard hat 20 includes a lower surface 44 that extends radially inward from a bottom of channels 34, 42. As will be described in more detail below, a portion of coupling structure 60 interfaces with lower surface 44 to couple coupling structure 60 to hard hat 20.

Figure 7:
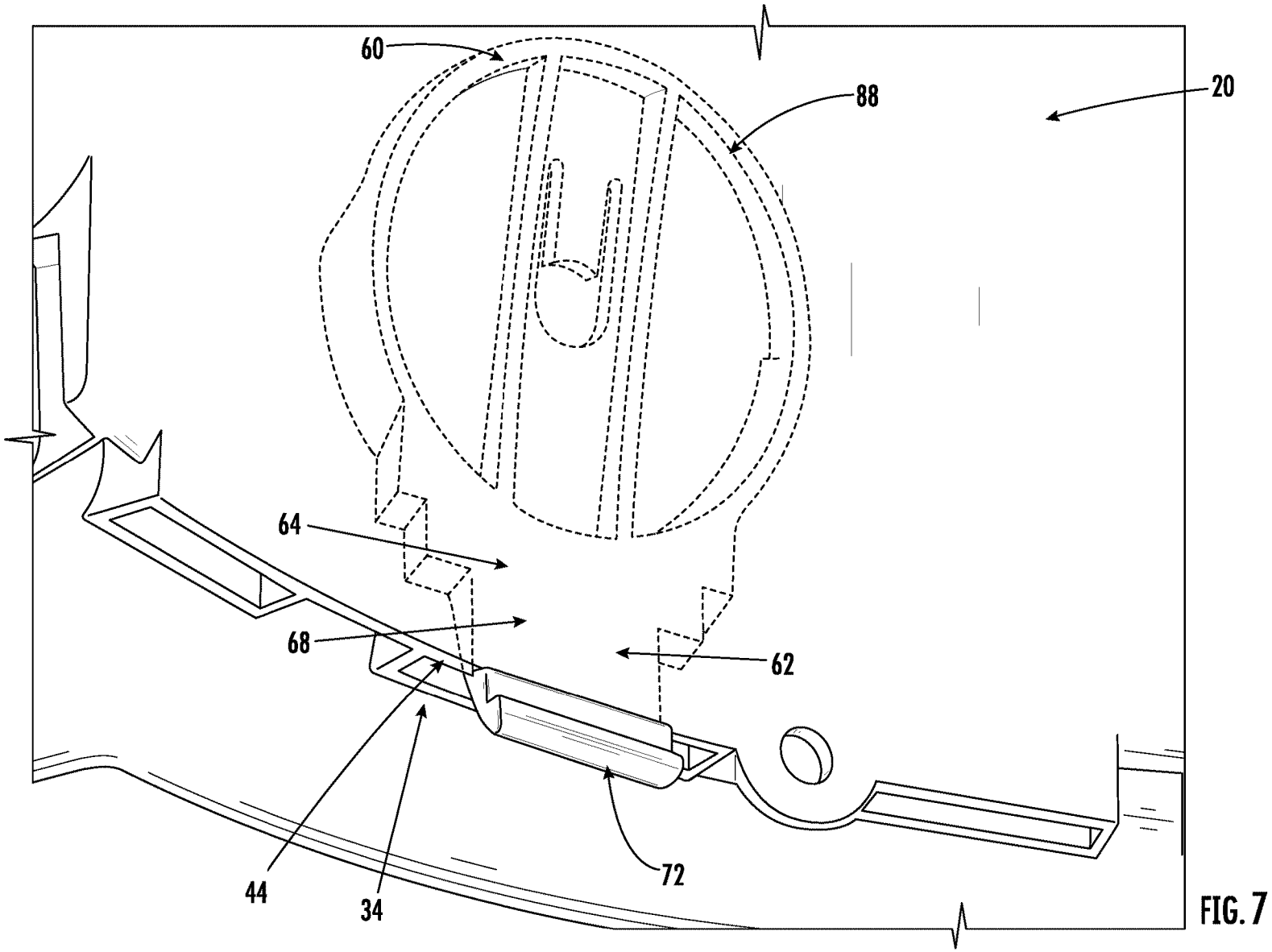
FIG. 7 is a detailed perspective view of a portion of the safety headwear system of FIG. 1, according to an exemplary embodiment.
Figure 8:
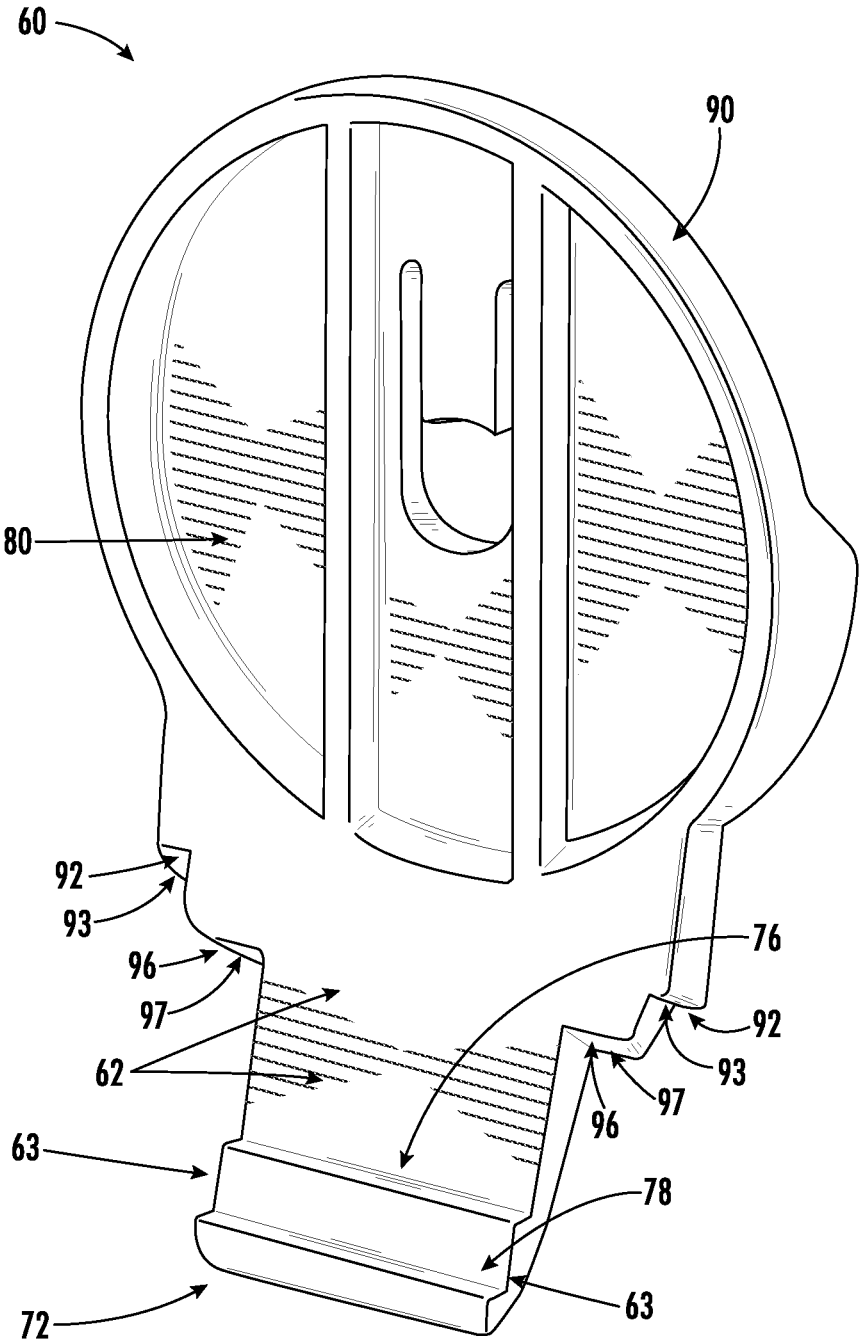
FIG. 8 is a perspective view of the coupling structure of FIG. 1, according to an exemplary embodiment.

Referring to FIGS. 7-8, various aspects of coupling structure 60 are shown, such as coupling structure 60 being coupled to hard hat 20. Coupling structure 60 includes an attachment structure 88 that couples to one or more accessories for hard hat, such as ear muffs. In various embodiments, attachment structure 88 includes a first projection 89 and a second projection 91. Arm 62 extends downwardly from body 90 and attachment structure 88 to end 72 of arm 62. In various embodiments, arm 62 defines an arcuate shape that is concave with respect to the center (e.g., axis 50) of hard hat 20. Arm 62 includes upper portion 64, middle portion 68, and end 72 opposite upper portion 64. Middle portion 68 is arranged between upper portion 64 and end 72. Coupling structure 60 includes a first surface, shown as first step surface 76, and a second surface, shown as second step surface 78. First step surface 76 and second step surface 78 face upward away from end 72 of arm 62. Second step surface 78 is between first step surface 76 and end 72 of arm 62.

In various embodiments, first step surface 76 and second step surface 78 extend radially inwards towards axis 50 when coupling structure 60 is coupled to hard hat 20. First step surface 76 and second step surface 78 are vertically arranged along an interior of arm 62.

Arm 62 and/or body 90 of coupling structure 60 includes first support surface 92 and/or second support surface 96. First support surface 92 and second support surface 96 each face downward. First support surface 92 includes two portions 93 extending away from opposing sides 63 of arm 62 and that are coplanar with respect to each other. The two portions 93 of the first support surface 92 define a distance 66 apart from each other. Second support surface 96 includes two portions 97 extending away from opposing sides 63 of the arm 62 and that are coplanar with respect to each other. The two portions 97 of the second support surface 96 define a distance 70 apart from each other that is less than the distance 66. In various embodiments, second support surface 96 is between the end 72 of the arm 62 and the first support surface 92. Stated another way, in various embodiments second support surface 96 is below first support surface 92 when coupling structure 60 is arranged in the upright configuration.

When coupling structure 60 is coupled to hard hat 20 in a first position, arm 62 extends through first aperture 28 and first step surface 76 interfaces with lower surface 44 of hard hat 20 (FIG. 7). Stated another way, first step surface 76 interfaces with the hard hat 20 when the coupling structure 60 is coupled to the hard hat 20 via the arm 62 extending through the first aperture 28. In the first position, upper portion 64 of arm 62 slidably engages with first aperture 28. In a specific embodiment, the distance 66 of upper portion 64 is approximately equal to length 30 of first aperture 28.

In various embodiments, first support surface 92 interfaces with the hard hat 20 when the coupling structure 60 is coupled to the hard hat 20 via the arm 62 extending through the first aperture 28. In various embodiments, second support surface 96 interfaces with the hard hat 20 when the coupling structure 60 is coupled to the hard hat 20 via the arm 62 extending through the second aperture 36.

When coupling structure 60 is coupled to hard hat 20 in a second position different than first position, protrusion extends through second aperture 36 and second step surface 78 interfaces with lower surface 44. Stated another way, second step surface 78 interfaces with the hard hat 20 when the coupling structure 60 is coupled to the hard hat 20 via the arm 62 extending through the second aperture 36. In the second position, middle portion 68 of arm 62 slidably engages with second aperture 36. In a specific embodiment, the distance 70 of middle portion 68 is approximately equal to length 38 of second aperture 36.

Figure 9:
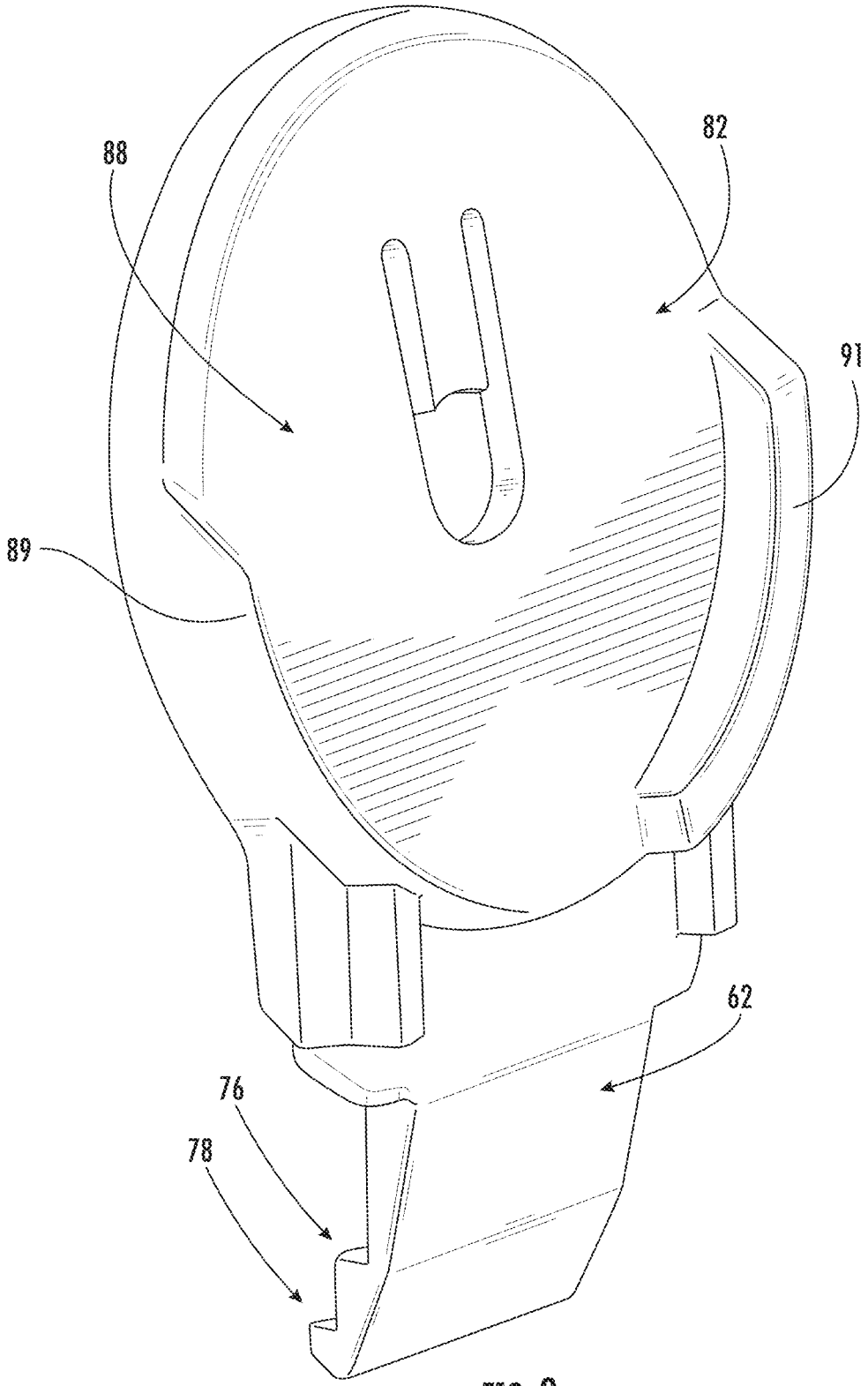
FIG. 9 is a perspective view of the coupling structure of FIG. 1, according to an exemplary embodiment.
Figure 10:
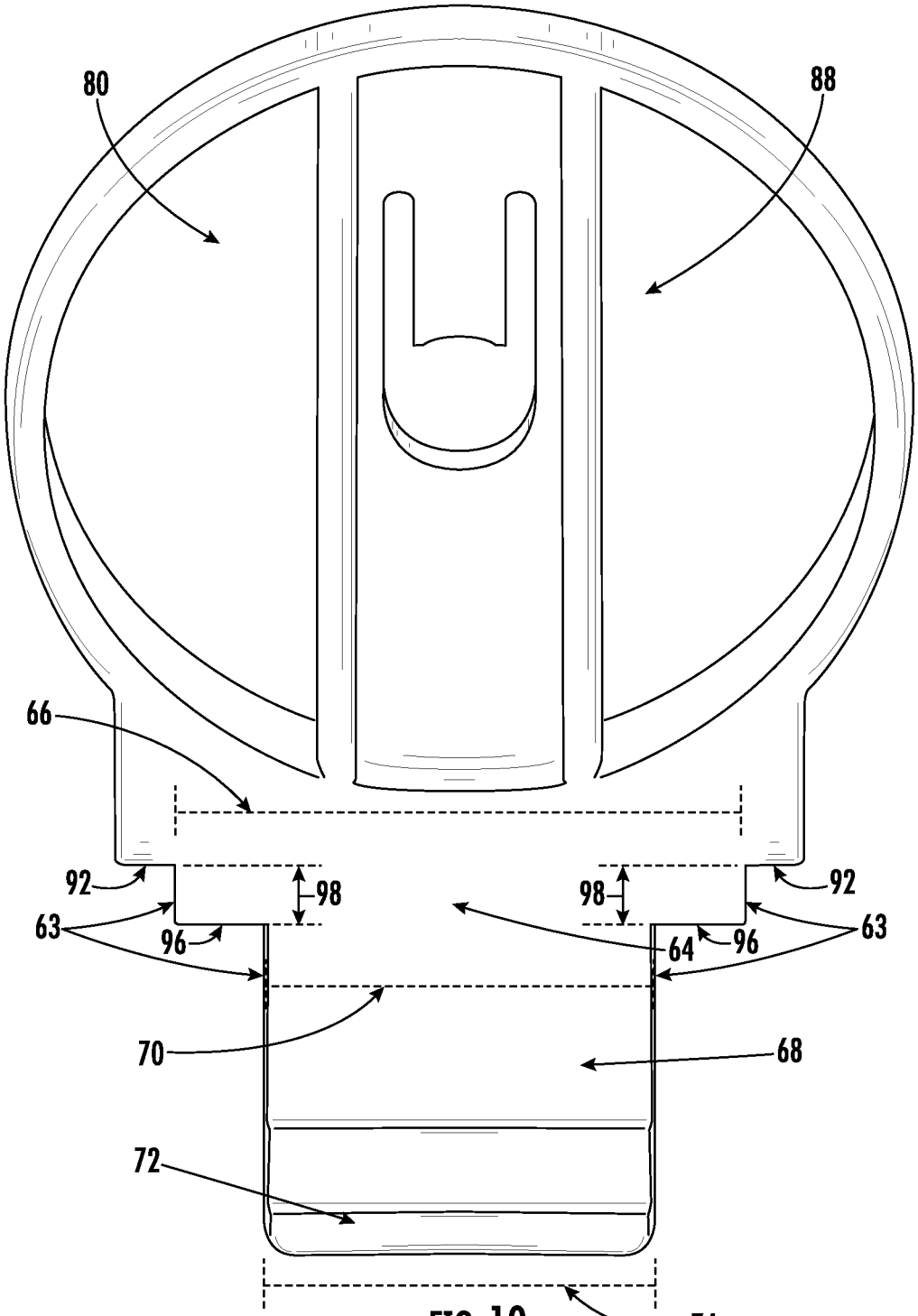
FIG. 10 is an interior view of the coupling structure of FIG. 1, according to an exemplary embodiment.
Figure 11:
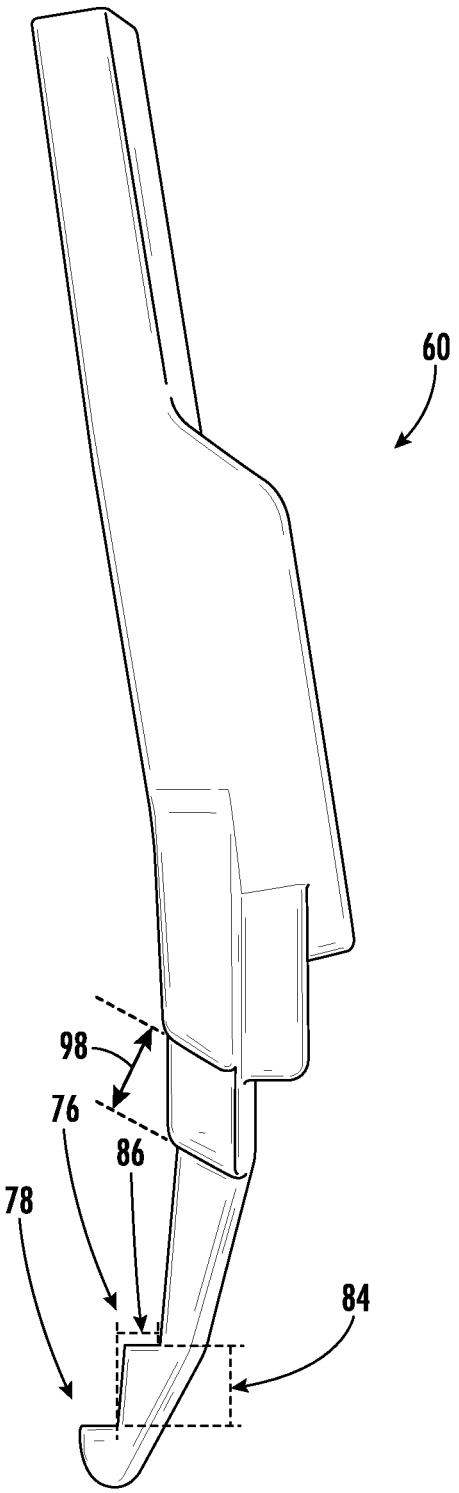
FIG. 11 is a side view of the coupling structure of FIG. 1, according to an exemplary embodiment.

Referring to FIGS. 9-11, coupling structure 60 includes an interior surface 80 opposite exterior surface 82. In a specific embodiment, upper portion 64 laterally extends distance 66, middle portion laterally extends distance 70, and end 72 laterally extends distance 74. In a specific embodiment, distance 66 is greater than distance 70 and distance 70 is equal to distance 74. In a specific embodiment, first step surface 76 is height 84 above second step surface 78 when coupling structure is arranged vertically (FIG. 11), such as when coupled to hard hat 20. In various embodiments, distance 98 between the first support surface 92 and the second support surface 96 is equal to or approximately equal to a (vertical) distance 84 between the first step surface 76 and the second step surface 78. For example, in various embodiments distance 98 is within 10% of distance 84, or more specifically within 5%, or more specifically within 1%. In various embodiments, first step surface 76 is distance 86 closer to axis 50 than second step surface 78 when coupling structure is arranged vertically (FIG. 11). Stated another way, in various embodiments second step surface 78 radially further from a center (e.g., axis 50) of hard hat 20 than the first step surface 76.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

What is claimed is:

1. A safety headwear system comprising:

a safety headwear comprising:

a shell formed from a rigid material, the shell defining an external surface and an opposing internal surface that defines a cavity sized to receive the head of a wearer, the shell centered on a vertical axis;

a first aperture extending along the external surface of the shell; and a second aperture extending along the external surface of the shell;

an accessory coupled to and configured to be used contemporaneously with the safety headwear; and a coupling structure comprising:

a body coupled to the accessory, the body comprising:

a radially outward facing surface;

opposing edges that define a first width; and a projection extending outward from the radially outward facing surface, the projection comprising:

an outer surface flush with one of the opposing edges of the body; and an inner surface opposing the outer surface, the inner surface of the projection configured to support the accessory;

an arm extending downward from the body to an end of the arm;

a first support surface facing downward, the first support surface comprising two coplanar portions extending away from opposing sides of the arm, the two portions of the first support surface define a first distance apart from each other;

a second support surface facing downward, the second support surface comprising two coplanar portions extending away from opposing sides of the arm, the two portions of the second support surface define a second distance apart from each other that is less than the first distance; and a first step surface facing upward away from the end of the arm, the first step surface extending radially inward towards the vertical axis when the coupling structure is coupled to the safety headwear;

wherein the first step surface extends laterally continuously along an entire second width of a middle portion of the arm, wherein the second width is defined between opposing edges of the first step surface, and wherein the first width is greater than the second width; and wherein each of the opposing sides of the end of the arm connect to the respective opposing edge of the body via contiguous surfaces, wherein the contiguous surfaces comprise the first support surface and the second support surface.

2. The safety headwear system of claim 1, wherein the first aperture extends a first length and the second aperture extends a second length, wherein the first length is longer than the second length.

3. The safety headwear system of claim 2, comprising a third aperture extending the second length, the second aperture and the third aperture positioned on opposing ends of the first aperture.

4. The safety headwear system of claim 1, wherein the second support surface is positioned between the end of the arm and the first support surface.

5. The safety headwear system of claim 1, wherein the first support surface interfaces with the safety headwear when the coupling structure is coupled to the safety headwear via the arm extending through the first aperture.

6. The safety headwear system of claim 1, wherein the second support surface interfaces with the safety headwear when the coupling structure is coupled to the safety headwear via the arm extending through the second aperture.

7. The safety headwear system of claim 1, wherein the arm defines an arcuate shape that is concave with respect to the safety headwear.

8. The safety headwear system of claim 1, wherein the coupling structure comprises a second step surface facing upward away from the end of the arm, the second step surface extending radially inward towards the vertical axis when the coupling structure is coupled to the safety headwear, wherein the second step surface extends laterally continuously along the entire width of the middle portion the arm.

9. The safety headwear system of claim 8, wherein the first step surface extends a first distance and the second step surface extends a second distance, and wherein the second distance is the same as the first distance.

10. The safety headwear system of claim 8, further comprising:

a first height defined between the first step surface and the second step surface; and a second height defined between the first support surface and the second support surface;

wherein the second height is within 10% of the first height.

11. The safety headwear system of claim 1, wherein the middle portion of the arm is positioned between the second support surface and the end of the arm.

12. A safety headwear system comprising:

a safety headwear comprising:

a shell formed from a rigid material, the shell defining an external surface and an opposing internal surface that defines a cavity sized to receive the head of a wearer, the shell centered on a vertical axis;

a first aperture extending along the external surface of the shell; and a second aperture extending along the external surface of the shell;

an accessory coupled to and configured to be used contemporaneously with the safety headwear; and a coupling structure comprising:

a body coupled to the accessory, the body comprising: an exterior surface facing away from the shell; and a first projection comprising an outer surface flush with a first portion of an outer edge of the exterior surface and an inner surface opposing the outer surface, the projection extending outward from the exterior surface, the inner surface of the first projection configured to support the accessory;

an arm extending downward from the body to an end of the arm;

a first step surface facing upward away from the end, the first step surface extending radially inwardly from the arm towards the vertical axis when the coupling structure is coupled to the safety headwear, wherein the first step surface extends laterally a first distance; and a second step surface facing upward away from the end, the second step surface between the first step surface and the end of the arm, the second step surface extending radially inwardly from the arm towards the vertical axis when the coupling structure is coupled to the safety headwear, wherein the second step surface extends laterally a second distance, and wherein the second distance is the same as the first distance.

13. The safety headwear system of claim 12, wherein the first aperture extends a first length and the second aperture extends a second length that is longer than the first length.

14. The safety headwear system of claim 12, wherein the first step surface interfaces with the safety headwear when the coupling structure is coupled to the safety headwear via the arm extending through the first aperture.

15. The safety headwear system of claim 14, wherein the second step surface interfaces with the safety headwear when the coupling structure is coupled to the safety headwear via the arm extending through the second aperture.

16. The safety headwear system of claim 12, wherein the arm defines an arcuate shape that is concave with respect to the safety headwear.

17. The safety headwear system of claim 12, wherein the coupling structure comprises a first support surface facing downward, the first support surface comprising two coplanar portions extending away from opposing sides of the arm, the first support surface interfacing with the safety headwear when the coupling structure is coupled to the safety headwear via the arm extending through the first aperture.

18. The safety headwear system of claim 17, wherein the two portions of the first support surface define a first distance apart from each other, the coupling structure comprising a second support surface facing downward, the second support surface comprising two coplanar portions extending away from opposing sides of the arm, the two portions of the second support surface define a second distance apart from each other that is less than the first distance, wherein the second support surface is between the end of the arm and the first support surface.

19. The safety headwear system of claim 12, wherein the first projection is curved and the inner surface faces an opposing second portion of the outer edge of the exterior surface.

20. The safety headwear system of claim 12, further comprising a second projection comprising an outer surface flush with a second portion of the outer edge of the exterior surface of the body and an inner surface opposing the outer surface of the second projection, wherein the second portion of the outer edge opposes the first portion of the outer edge, and wherein the inner surface of the second projection supports the accessory.

* * * * *